US007928853B2

(12) United States Patent
Frost-Gaskin

(10) Patent No.: US 7,928,853 B2
(45) Date of Patent: Apr. 19, 2011

(54) ALARM UNIT

(76) Inventor: Peter Frost-Gaskin, Horley (GB)

( * ) Notice: Subject to any disclaimer, the term of this patent is extended or adjusted under 35 U.S.C. 154(b) by 920 days.

(21) Appl. No.: 11/474,757

(22) Filed: Jun. 26, 2006

(65) Prior Publication Data

US 2007/0001860 A1 Jan. 4, 2007

Related U.S. Application Data

(63) Continuation of application No. PCT/GB2004/005451, filed on Dec. 23, 2004.

(51) Int. Cl.
*G08B 17/00* (2006.01)

(52) U.S. Cl. ..... 340/628; 340/629; 340/630; 340/584; 340/693.1; 340/693.2; 340/577

(58) Field of Classification Search ..... None
See application file for complete search history.

(56) References Cited

U.S. PATENT DOCUMENTS

| | | | | |
|---|---|---|---|---|
| 3,594,752 | A * | 7/1971 | Alton | 340/585 |
| 3,872,355 | A * | 3/1975 | Klein et al. | 361/45 |
| 4,027,302 | A | 5/1977 | Healey et al. | 340/227 |
| 4,363,556 | A * | 12/1982 | Belliveau et al. | 374/183 |
| 4,521,645 | A * | 6/1985 | Carroll | 379/42 |
| 4,717,910 | A * | 1/1988 | Scripps et al. | 340/693.1 |
| 6,084,522 | A * | 7/2000 | Addy | 340/630 |
| 6,084,552 | A | 7/2000 | Robertson et al. | 343/753 |
| 2002/0011570 | A1 * | 1/2002 | Castleman | 250/339.15 |

FOREIGN PATENT DOCUMENTS

DE 296 08 999 9/1996

* cited by examiner

*Primary Examiner* — Julie Lieu
(74) *Attorney, Agent, or Firm* — Heslin Rothenberg Farley & Mesiti P.C.; Victor A. Cardona

(57) ABSTRACT

An alarm unit, for sounding an alarm on detection of a fire emergency condition, which comprises a smoke detector, an alarm indicator and a heat detector wherein the smoke detector is capable of receiving power from a first power source and the heat detector is capable of receiving power from a second power source.

40 Claims, 5 Drawing Sheets

Figure 2A:
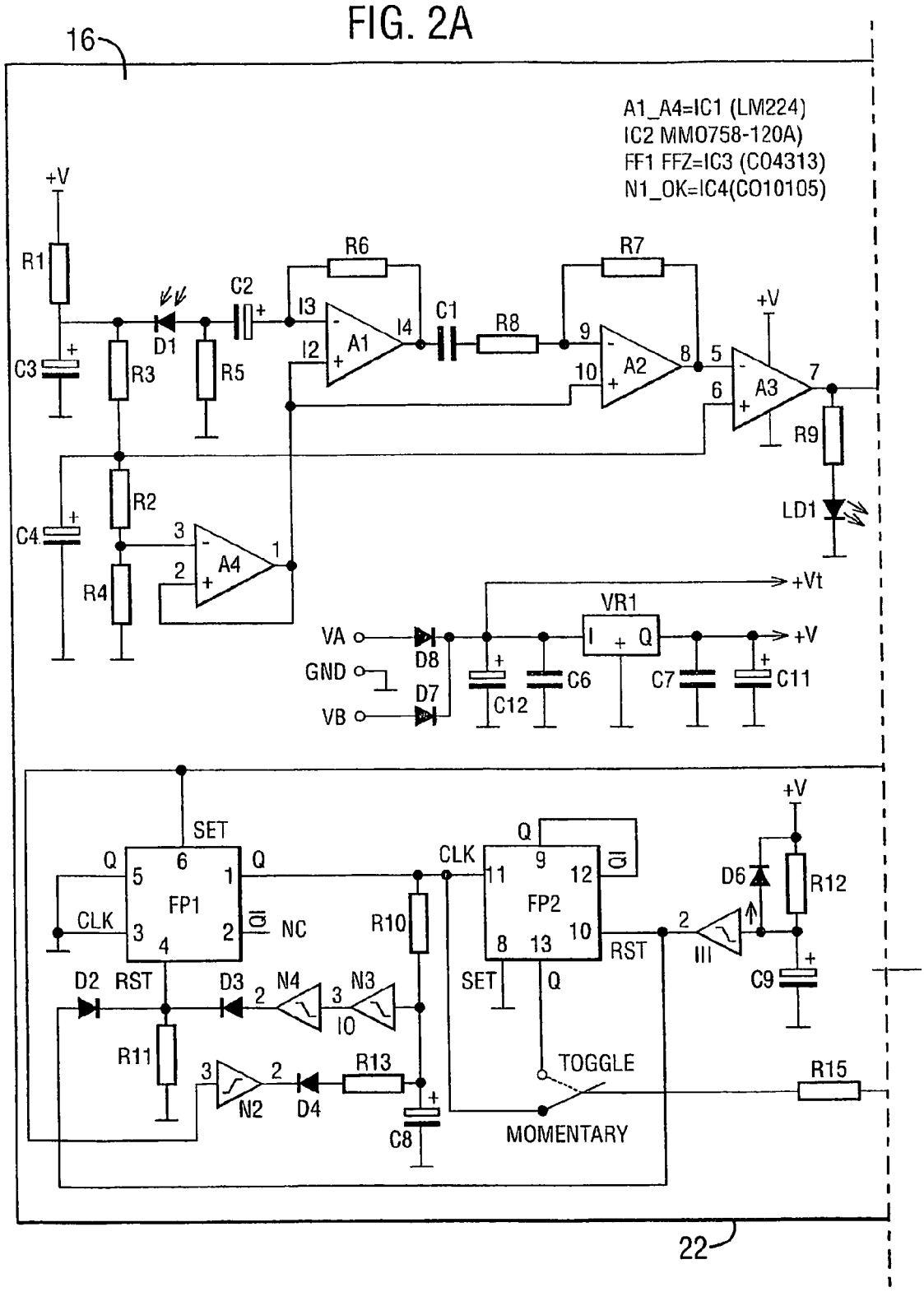

FIG. 2A (Contd.)
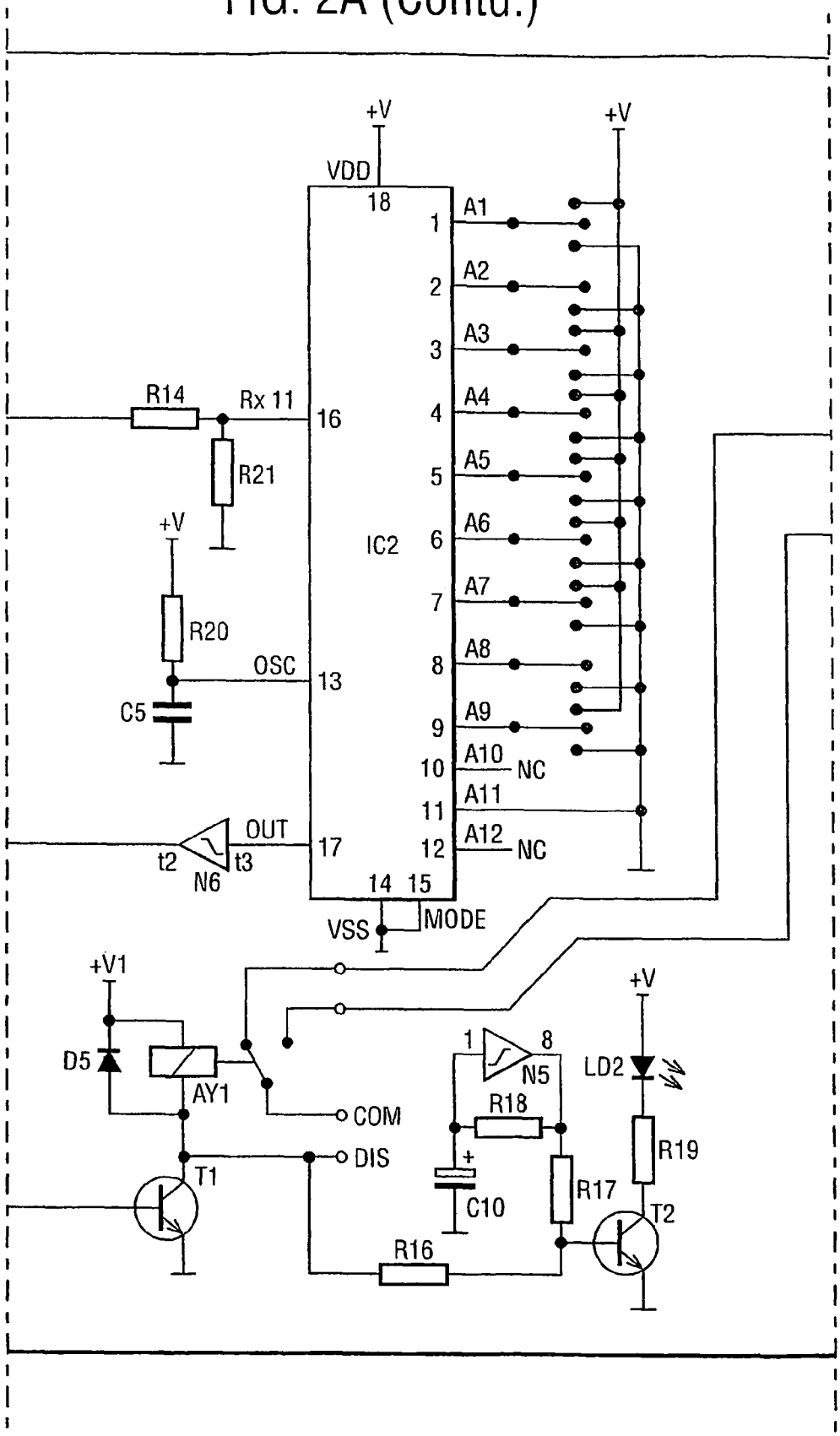

FIG. 2A (Contd.)
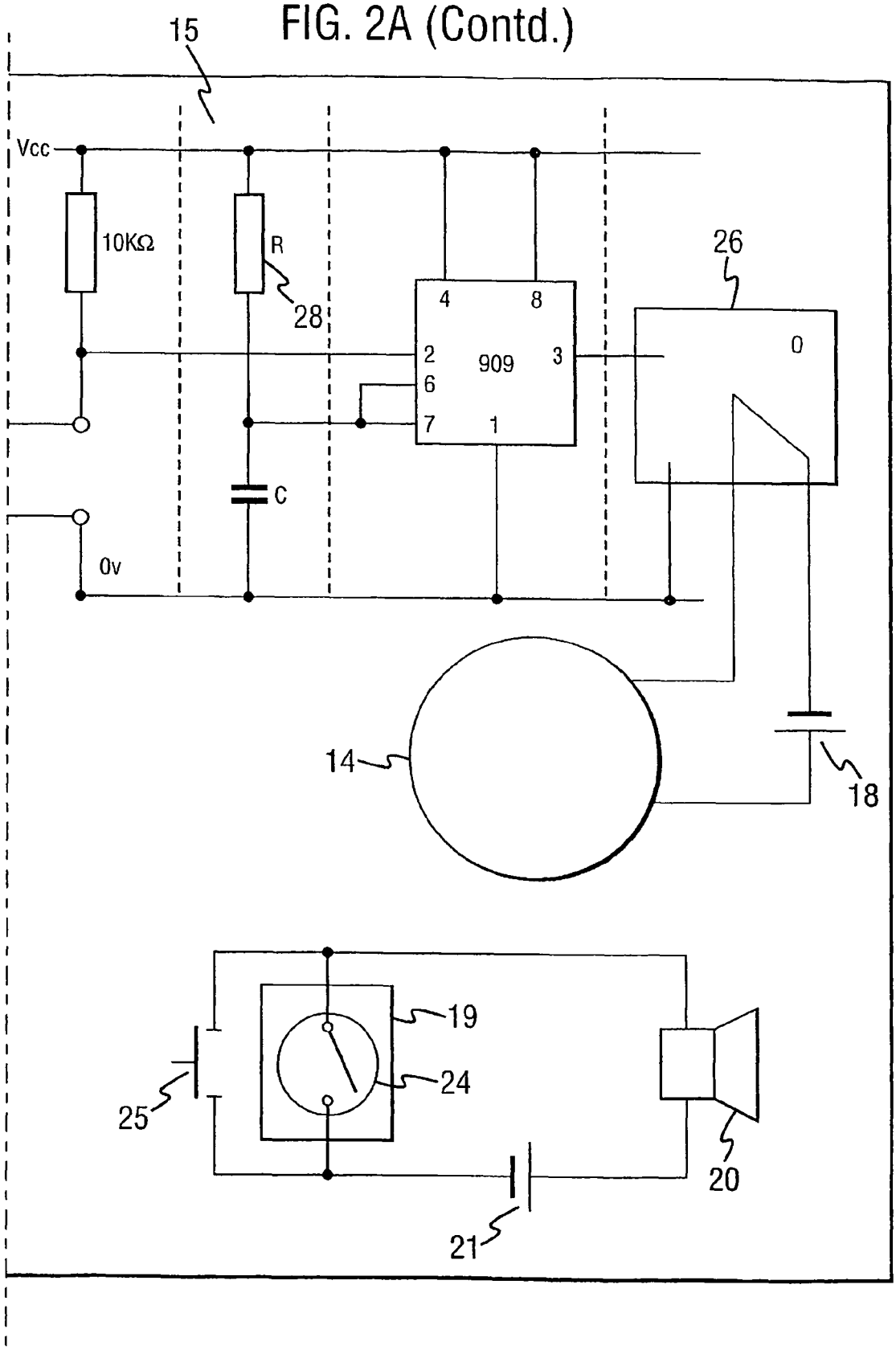

ALARM UNIT

CROSS REFERENCE TO RELATED APPLICATIONS

This application is a continuation of PCT International Application No. PCT/GB2004/005451, filed on Dec. 23, 2004, and published in English on Jul. 7, 2005, as WO 2005/062271 A1, which claims priority to GB 0329950.0, filed Dec. 24, 2003, the entire disclosures of which are incorporated herein by reference.

The present invention relates to an alarm unit, for sounding an alarm on detection of a fire emergency condition, which comprises a smoke detector, a sounder and a heat detector wherein the smoke detector is capable of receiving power from a first power source and the heat detector is capable of receiving power from a second power source.

Within the context of the present application, the word "comprises" is taken to mean "includes among other things", and is not taken to mean "consists of only".

Within the context of the present application, the word "about" is taken to mean "±10%".

Within the context of the present application, the word "sounder" is taken to mean "a device capable of converting a received instruction (for example an electrical signal) into an audible alarm".

Existing alarm units are subject to design weaknesses which make them inadequate in practical use, considering the important part they play in saving peoples' lives. These weaknesses, which are discussed below, result in alarm units which are fitted in houses, offices etc, not being fully operational. Often alarm units are not properly maintained, for example, many known alarm units are powered by a cell or battery which has a limited lifespan and often when the cell or battery loses charge, for various reason it does not get replaced. This may be due to the user of the alarm unit not being aware of the need to replace a cell or battery, finding it inconvenient to replace a cell or battery or simply forgetting to replace a cell or battery. These are potentially life threatening problem.

Most known alarm units are powered by cells or batteries, have a sounder and are mounted on a ceiling, where they are difficult to reach. They are located here so that they are unobtrusive and unlikely to be disturbed, but it ensures that the sounder is difficult to mute in the case of false alarms. In addition, replacement of cells or batteries can be difficult, especially for the elderly, children, and disabled. This could lead to non-replacement of a power cell or battery which has lost charge.

Furthermore, many known alarm units are prone to false alarms. An example of a reason for a false alarm could be due to detection of smoke from burnt toast. This can be irritating and has been known to result in removal of a power cell or battery or disconnection of an alarm unit from its power source to prevent false alarms. When an alarm unit is disabled to prevent recurrence of a false alarm, the alarm unit might not be reconnected immediately. This could lead to a life threatening situation if an alarm unit is left in an inoperable condition.

Some known alarm units comprise a receiver which can communicate with a long-range radio frequency remote controls that allows their sounder to be muted remotely. However, these long-range radio frequency remote controls can be dangerous, because they allow a muting of a sounder to be controlled without line of sight between the remote control and the receiver. For example, if the receiver is in one room of a house, the remote control can be operated from a different room in the house, on the assumption of it being a false alarm, without necessarily investigating the reason for the sounder sounding.

Combined "intruder and smoke" alarm units are also known and these incorporate a smoke/carbon monoxide detector and an intruder detection system. These tend to be prohibitively expensive and complicated to install. They are known to comprise a long-range radio frequency remote control which allows remote activation or deactivation of the intruder detection system and/or remote muting of a sounder linked to the smoke detector. As discussed above, these remote controls can be dangerous.

U.S. Pat. No. 4,319,229 describes an alarm system which comprises three separate and diverse sensors; a heat detector, a smoke detector, and an infrared radiation detector. One or a combination of these detectors can provide a signal to activate a sounder. The use of an infrared detector permits detection of an intruder.

U.S. Pat. No. 3,938,115 describes an alarm unit having a smoke detector and a heat detector wherein each detector is linked to a self-contained energy source in the form of compressed gas.

A need therefore exists for an improved, user friendly alarm unit that encourages proper maintenance and includes a means for easily and safely muting a sounder in the case of false alarms, thereby reducing the likelihood of the alarm unit being left in an inoperative condition. Furthermore, a need exists for a smoke alarm unit that has a means to ensure that a sounder will sound when there is a fire, even if a main power source has lost charge and has not been replaced. In addition, a need exists for an alarm unit which has means to allow muting of a sounder in the event that there is a false alarm only after investigation of the reason for the sounder sounding.

Remarkably, the present invention provides an improved alarm unit which addresses the problems described above.

In a first aspect, the present invention provides an alarm unit which comprises a smoke detector, a heat detector and a first alarm indicator, wherein the smoke detector is capable of receiving electrical power from a first electrical power source and the heat detector is capable of receiving electrical power from the first electrical power source and/or a second electrical power source.

In a preferred embodiment the alarm indicator is a sounder or a light source. Preferably, the alarm indicator is a sounder.

In a preferred embodiment of the invention, the smoke detector is capable of receiving electrical power exclusively from the first electrical power source. Preferably, the heat detector is capable of receiving electrical power exclusively from the second electrical power source.

In a preferred embodiment, the heat detector and the smoke detector are in electrical communication with the first alarm indicator. Advantageously, the use of a single alarm indicator reduces component numbers and cost.

In an alternative embodiment the alarm unit additionally comprises a second alarm indicator, wherein the second alarm indicator is in electrical communication with the heat detector, but not the smoke detector. Preferably, the second alarm indicator is a sounder or a light source. More preferably, the alarm indicator is a sounder.

In a preferred embodiment the first alarm indicator is not in electrical communication with the heat detector and the second alarm indicator is not in electrical communication with the smoke detector.

In a preferred embodiment the alarm unit comprises terminals for receiving power from the first power source and terminals for receiving power from the second power source, wherein the terminals for receiving power from the first power source are in electrical communication with the smoke detector and the terminals for receiving power from the second power source are in electrical communication with the heat detector.

In a preferred embodiment the first power source and the second power source comprise at least one cell or a battery. Preferably, the second power source comprises a long-life cell or battery and more preferably the long-life cell or battery is a lithium cell or battery.

In an alternative embodiment the first power source is a mains power source.

In a preferred embodiment the heat detector is capable of causing a signal which instructs an alarm to be indicated if temperatures rise above a predetermined temperature of about 40° C., more preferably of about 50° C. For example, in use, when a temperature above the predetermined temperature is detected the heat detector causes an electrical circuit including the second power source, the heat detector and an alarm indicator to be completed.

In a preferred embodiment the heat detector comprises a heat switch which can be in an "OFF" state wherein electrical current cannot flow through the heat switch or in an "ON" state wherein electrical current can flow through the heat switch. At temperatures below the predetermined temperature the heat switch is in the "OFF" state and when temperatures rise above the predetermined temperature the heat switch switches to an "ON" state. A rise in temperature and the consequent transition of the heat switch to an "ON" state completes an electrical circuit connecting the heat switch, the second power source and an alarm indicator, thereby allowing an electrical current to pass through the alarm indicator causing an alarm to be indicated, for example, if the alarm indicator is a sounder, an alarm to be sounded, or if the alarm indicator is a light source, a light to be emitted.

In a preferred embodiment the heat switch comprises a thermistor.

When the heat switch is switched to its "ON" state by a rise in temperature, the alarm indicator indicates an alarm, for example if the alarm indicator is a sounder, the sounder sounds, and it cannot be muted. Indication of an alarm ceases, for example the sounder is silenced, when the temperature drops below the pre-determined temperature and the heat switch returns to its "OFF" state. Advantageously, this ensures that even if, for example, the first power source of the alarm unit has been allowed to lose charge or if the smoke detector has been disabled, and a fire/heat source occurs, an alarm will be indicated.

In a preferred embodiment the alarm unit additionally comprises a control including a receiver and a remote transmitter wherein the smoke detector, the first alarm indicator and the receiver are in electrical communication.

In use, when the smoke detector detects smoke it is capable of causing a signal which is received by the first alarm indicator, which indicates an alarm. The control is capable of causing indication of an alarm by the first alarm indicator to cease, for example if the first alarm indicator is a sounder the sounder can be muted, and it is intended that this facility should be used if the alarm unit indicates a false alarm.

In a preferred embodiment, the remote transmitter can be instructed to transmit a signal which can be received by the receiver. When the receiver receives this signal it causes indication of an alarm by the first alarm indicator to cease, for example by cutting power from the first power source to the smoke detector and the first alarm indicator.

Preferably, the receiver comprises an infrared receiver and the remote transmitter comprises an infrared transmitter. In use, the infrared transmitter can be instructed to transmit an infrared signal which can be received by the infrared receiver if the infrared receiver and the infrared transmitter are in a line of sight and are spaced apart no further than a maximum distance in the range of 5 to 10 meters. More preferably, the maximum distance at which the infrared transmitter and the infrared receiver can be spaced apart is variable. For example, in a preferred embodiment the sensitivity of the infrared receiver can be adjusted to alter the maximum distance at which the infrared transmitter and the infrared receiver can be spaced apart.

Advantageously, the use of an infrared receiver and a remote infrared transmitter allows indication of an alarm by the alarm unit to cease or be muted only when the infrared receiver and the remote infrared transmitter are in a line of sight and are within a predetermined range of the alarm unit. This prevents indication of an alarm from ceasing or being muted from a distant location where the user cannot see the alarm unit and therefore cannot ensure that there is a false alarm. This ensures that the user is forced to check whether there is a false alarm before ceasing indication of an alarm by an alarm indicator.

In a preferred embodiment, the infrared receiver and the remote infrared transmitter are provided with means for preventing other infrared devices causing interference with their operation.

Preferably, the infrared transmitter transmits a signal at a specific infrared frequency or tone and the infrared receiver selectively receives an infrared signal of the specific frequency or tone. The specific frequency or tone may be different from that used in other household infrared devices, for example television remote controls, thereby preventing interference from these devices. Alternatively, the infrared transmitter sends a coded signal and the infrared receiver selectively receives a signal with the appropriate code. Preferably the code is a three-digit code.

Advantageously, the remote control will be beneficial to users, making operation of the alarm user-friendly by allowing quick and easy cessation muting of false alarms. This should discourage users from disconnecting the power supply to the alarm unit or deliberately not replacing a power cell or battery that has lost charge in order to prevent false alarms. In contrast, if false alarms can be quickly and conveniently ceased or muted, users will be encouraged to properly maintain the alarm unit.

In a preferred embodiment, the alarm unit additionally comprises a timer. Preferably the timer is in electrical communication with the receiver, the smoke detector and the first alarm indicator. The timer is activated when the receiver receives a signal from the remote transmitter. On completion of a predetermined timed period the timer instructs cessation or muting of the first alarm indicator to cease, for example by restoring power from the first power source to the smoke detector and the first alarm indicator.

In an alternative embodiment the receiver and the timer are capable of receiving electrical power from a third electrical power source. Preferably, the alarm unit comprises terminals for receiving power from the third power source, wherein the receiver and the timer are in electrical communication with the terminals for the third power source.

In a further preferred embodiment the remote transmitter is capable of receiving electrical power from an electrical power source. Preferably, the remote transmitter comprises terminals for receiving power from the power source.

In a preferred embodiment, the alarm unit comprises a test facility to enable testing of the first and/or second power source to establish whether it has a sufficient level of charge to cause indication of an alarm by an alarm indicator. Preferably, the test facility is for testing the second power source.

Preferably, the test facility comprises a switch which is in electrical communication with the second power source and an alarm indicator wherein the switch and the heat detector are connected in parallel. Preferably the switch is a push-button switch. When the switch is pressed an electrical circuit connecting the alarm indicator and the second power source is completed, allowing an electrical current to pass through the alarm indicator thereby causing indication of an alarm, for example sounding of a sounder, if the second power source has a sufficient level of charge.

Preferably, the test facility, additionally or alternatively, comprises a switch which is in electrical communication with the first power source and an alarm indicator wherein the switch and the smoke detector are connected in parallel. Preferably the switch is a push-button switch.

In a preferred embodiment, the test facility comprises a switch which is located on the remote transmitter. In normal use the switch resides in a "OFF" state and switching of the switch to an "ON" state causes completion of a circuit, wherein completion of the circuit causes a signal to be transmitted from the remote transmitter. The alarm unit comprises a receiver which is in electrical communication with the second power source and an alarm indicator and which is capable of receiving the signal from the remote transmitter. When the receiver receives the signal it causes a circuit linking the second power source and an alarm indicator to be completed, allowing an electrical current to pass through the alarm indicator, which thereby indicates an alarm if the second power source has a sufficient level of charge. Preferably, the switch is a push button switch. It will be appreciated that the alarm unit may comprise a test facility additionally, or alternatively, capable of testing the first power source, having a corresponding arrangement to that described above.

In a preferred embodiment the alarm unit has a housing which defines fixing apertures for mounting the housing to a ceiling. Preferably, the housing comprises a plastic case that enables promotion of the convection of air thereby maximising the sensitivity of the smoke detector and the heat detector.

Figure 1A:
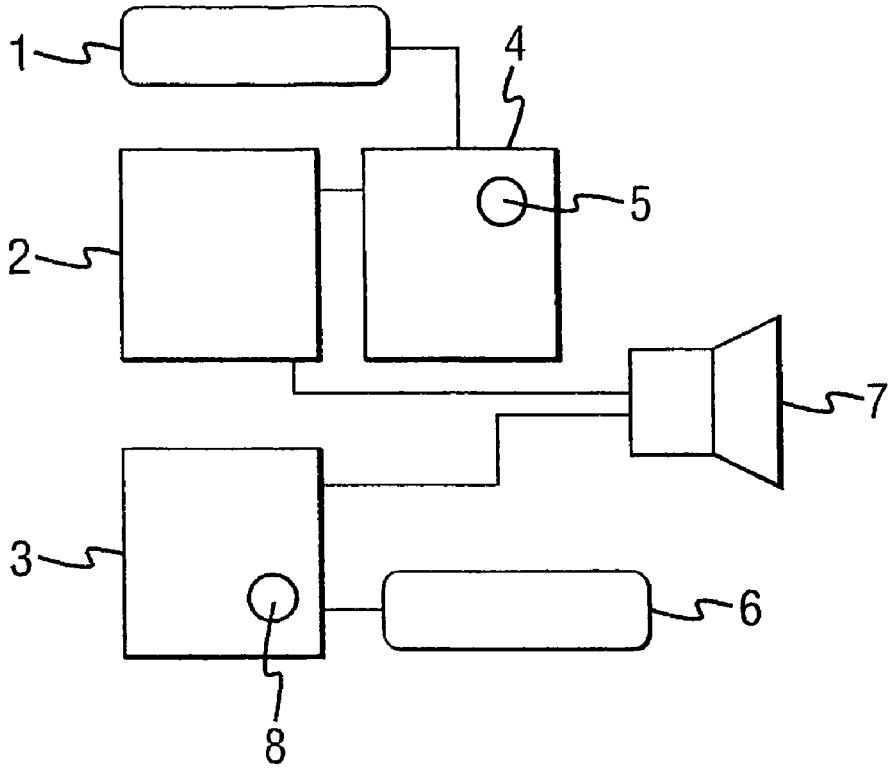
Figure 1B:
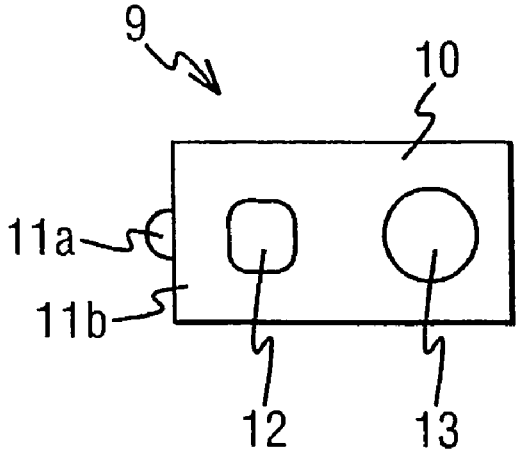
Figure 2B:
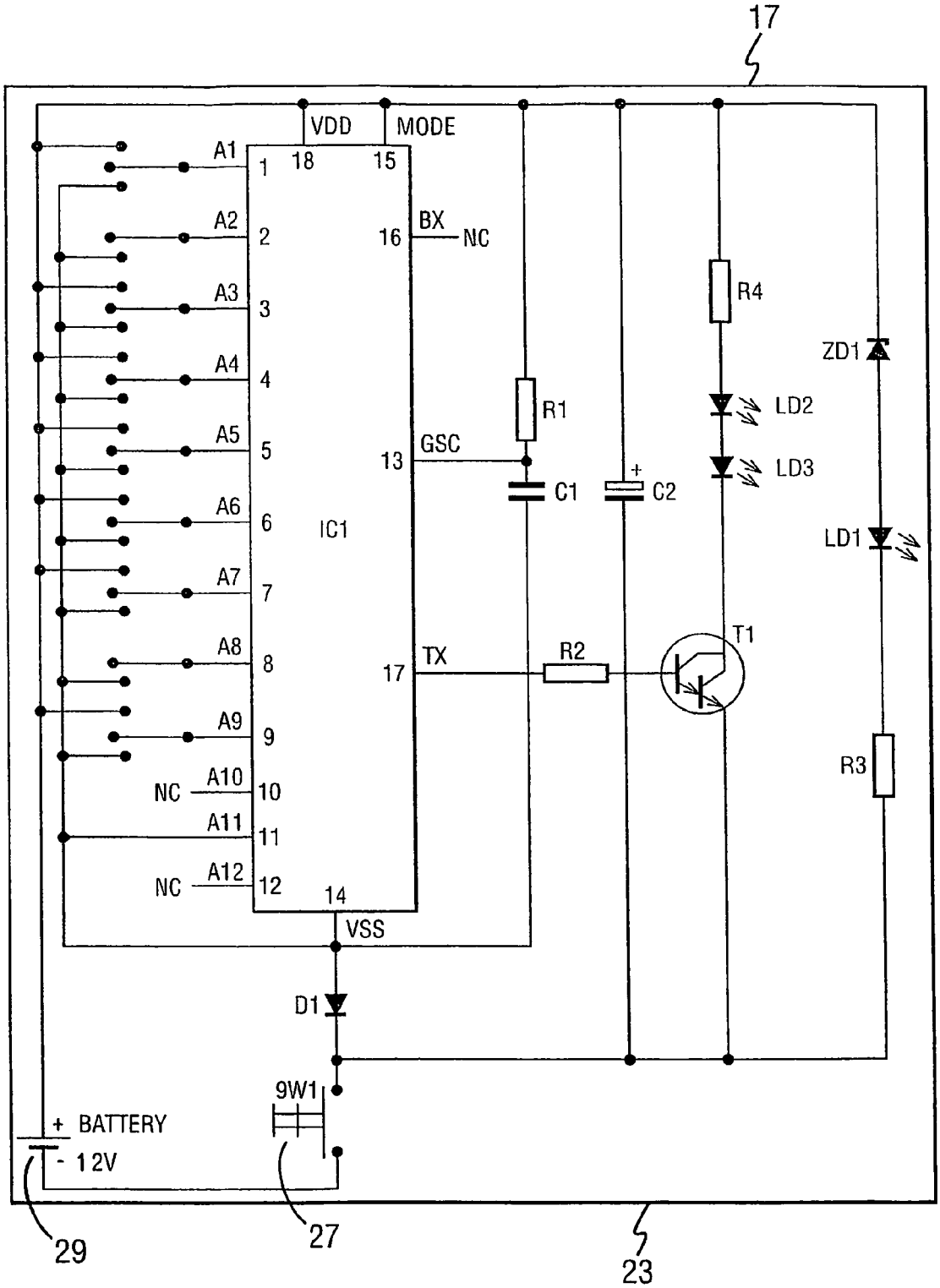

Additional features and advantages of the present invention are described in, and will be apparent from, the description of the presently preferred embodiments which are set out below with reference to the drawings in which:

FIGS. 1A and 1B show schematic diagrams of a preferred embodiment of an alarm unit according to the present invention FIGS. 2A and 2B show circuit diagrams of a preferred embodiment of an alarm unit according to the present invention.

For the purposes of clarity and a concise description features are described herein as part of the same or separate embodiments, however it will be appreciated that the scope of the invention may include embodiments having combinations of all or some of the features described.

A preferred embodiment of an alarm unit according to the present invention is illustrated in FIGS. 1A and 1B. The alarm unit comprises a first electrical power source (1), a smoke detector (2), a heat detector (3), a timer (4), a receiver (5) which is preferably an infrared receiver, a second electrical power source (6), a sounder (7) and a test switch (8), which is preferably a push-button switch. The first power source (1) is capable of supplying power to the smoke detector (2), the timer (4) and the sounder (7), and the second power source (6) is capable of supplying power to the heat detector (3) and the sounder (7).

Both the smoke detector (2) and the heat detector (3) are in electrical communication with the sounder (7). The smoke detector (2) is capable of sending a signal to the sounder (7) when it detects the presence of smoke, and the heat detector (3) is capable of sending a signal to the sounder (7) when it detects a temperature above a pre-determined temperature. The sounder (7) is capable of emitting a first tone when a signal is received from the smoke detector (2) and a different, second tone when a signal is received from the heat detector (3).

The first power source (1) can comprise a cell or a battery, such as a 9V square-type cell, a mains power source, or a combination of both. The second power source (6) comprises a long-life cell, such as a lithium cell or a similar long-life cell. When the test switch (8) is activated, an electrical circuit connecting the sounder (7) and the second power source (6) is completed, powering the sounder (7), thereby sounding if the second power source (6) has a sufficient level of charge. This enables the charge of the second power source (6) to be tested.

The alarm unit additionally comprises a control including the receiver (5) and a remote transmitter (9), as shown in FIG. 1B. Preferably the receiver (5) comprises an infrared receiver, and the remote transmitter (9) comprises an infrared transmitter (10). The infrared transmitter (10) comprises an infrared transmitter LED (11*a*) and a drive circuit (11*b*). Furthermore, the remote transmitter (9) comprises a switch (12), which can be a push-button switch, and a power source (13). The power source (13) can comprise, for example, a small penny cell or a lithium cell. The remote transmitter (9) is capable of transmitting a signal when the switch (12) is pressed. The signal is received by the receiver (5) and when the receiver (5) receives this signal it causes the first tone of the sounder (7) to be muted. This allows muting of the sounder (7) if the alarm unit indicates a false alarm.

Another preferred embodiment of an alarm unit according to the present invention is shown in FIGS. 2A and 2B. The alarm unit comprises a smoke detector and a first sounder (represented as a single unit (14) in FIG. 2A), a timer (15), an infrared receiver (16) and a remote infrared transmitter (17), a first power source (18), a heat detector (19), a second sounder (20) and a second power source (21). The smoke detector and the first sounder (14), the timer (15), the infrared receiver (16), the first power source (18), the heat detector (19), the second sounder (20) and the second power source (21) are located within a housing (22) and the remote infrared transmitter (17) is located within a separate housing (23).

The heat detector (19) comprises a heat switch (24), which can be in an "ON" state or an "OFF" state and when in its "ON" state completes an electrical circuit connecting the second sounder (20) and the second power source (21). This ensures that the second sounder (20) will sound in the event of a fire even if, for example, the first power source (18) has lost charge or has been disconnected. The second power source (21) is not accessible to a user and the second sounder (20) cannot be muted once the heat switch (24) is in its "ON" state. Only once the temperature has dropped below a pre-determined temperature, will the sounder cease to sound.

The second power source (21) is a lithium cell or battery, which has a shelf life of about ten years and which has sufficient power to sound a sounder for about 20 minutes or until the unit is destroyed by fire.

The alarm unit additionally comprises a push-button switch (25) which is in electrical communication with the second power source (21) and the second sounder (20) and wherein the push-button switch (25) and the heat switch (24) are in parallel. The push-button switch (25) enables a user to check whether the second power source (21) has sufficient charge because pressing the push-button switch (25) completes an electrical circuit connecting the second sounder (20) and the second power source (21), thereby enabling electrical current to flow through the second sounder (20) and sounding an alarm if the second power source (8) has sufficient charge.

As shown in FIG. 2A, the smoke detector and the first sounder (14) and the first power source (18) are linked in an electrical circuit which comprises a relay having a switch (26). The switch of the relay (26) can be in a first position, where this circuit is completed and thereby an electrical current can pass through the first sounder (14) causing it to sound if smoke is detected, or it can be in a second position where this circuit is broken. The switch of the relay (26) shown in FIG. 2A is in its first position. The infrared receiver (16) and the timer (15) are in electrical communication with the relay (26).

The infrared transmitter (17) comprises a button or switch (27) which can be pressed to mute the first sounder (14). The infrared transmitter (17) transmits an infrared signal which is received by the infrared receiver (16), provided the infrared receiver (16) and the infrared transmitter (17) are in a line of sight and within a predetermined range of each other. When the infrared signal is received, the infrared receiver (16) instructs the switch of the relay (26) to move to its second position thereby breaking the electrical circuit between the first power source (18), the smoke detector and the first sounder (14) and causing the first sounder to stop sounding. In addition, when the infrared receiver (16) receives an infrared signal it activates the timer (15). Once a pre-determined period has passed, the timer instructs the switch of the relay (13) to return to its original position, power to the smoke detector and the first sounder (14) is provided. The pre-determined period is sufficient for smoke causing a false alarm to dissipate and thus when the power is reconnected the alarm should no longer sound. Preferably, the pre-determined period is in the range of about 3 minutes to about 10 minutes. More preferably, the pre-determined period is in the range of about 4 minutes to about 6 minutes. Most preferably, the pre-determined period is about 5 minutes.

The infrared receiver and the remote infrared transmitter illustrated in FIGS. 2A and 2B comprise a single channel infrared code lock transmitter and receiver.

As shown in FIG. 2A, the timer (15) comprises a variable resistor (28), which can be used to alter the time period determined by the timer (15). This can be used during testing of the alarm unit to set the length of the period. In an alternative embodiment, the timer (15) may comprise a resistor of predetermined resistance.

The remote infrared transmitter is capable of receiving power from an electrical power source (29). In the illustrated embodiment the power source (29) comprises a 12V cell.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications are covered by the appended claims.

The invention claimed is:

1. An alarm unit which comprises:

a smoke detector, a heat detector and a first alarm indicator, wherein the smoke detector is configured to receive electrical power from a first electrical power source and the heat detector is configured to receive electrical power from a second electrical power source;

the first alarm indicator being in electrical communication with the first electrical power source and configured to indicate an alarm on receipt of a signal from the smoke detector or the heat detector, and the first alarm indicator being in electrical communication with the second electrical power source and configured to indicate an alarm on receipt of electrical power from the second electrical power source.

2. An alarm unit according to claim 1 wherein the alarm indicator is a light source.

3. An alarm unit according to claim 1 wherein the alarm indicator is a sounder.

4. An alarm unit according to claim 1 wherein the smoke detector is capable of receiving electrical power exclusively from the first electrical power source.

5. An alarm unit according to claim 1 wherein the heat detector is configured to receive electrical power exclusively from the second electrical power source.

6. An alarm unit according to claim 1 wherein the heat detector and the smoke detector are in electrical communication with the first alarm indicator.

7. An alarm unit according to claim 1 which additionally comprises a second alarm indicator, wherein the second alarm indicator is in electrical communication with the heat detector, but not the smoke detector.

8. An alarm unit according to claim 7 wherein the first alarm indicator is not in electrical communication with the heat detector and the second alarm indicator is not in electrical communication with the smoke detector.

9. An alarm unit according to claim 1 which comprises terminals for receiving power from the first power source and terminals for receiving power from the second power source, wherein the terminals for receiving power from the first power source are in electrical communication with the smoke detector and the terminals for receiving power from the second power source are in electrical communication with the heat detector.

10. An alarm unit according to claim 1 wherein the second power source comprises at least one cell or a battery.

11. An alarm unit according to claim 10 wherein the second power source comprises a long-life cell or battery.

12. An alarm unit according to claim 11 wherein the long-life cell or battery is a lithium cell or battery.

13. An alarm unit according to claim 1 wherein the first power source comprises at least one cell or battery, or is a mains power source.

14. An alarm unit according to claim 1 wherein the heat detector is capable of causing a signal which instructs an alarm to be indicated by the alarm indicator if temperatures rise above a predetermined temperature of about 40° C.

15. An alarm unit according to claim 14 wherein the heat detector is capable of causing a signal which instructs an alarm to be indicated if temperatures rise above a predetermined temperature of about 50° C.

16. An alarm unit according to claim 14 wherein, in use, when a temperature above the predetermined temperature is detected the heat detector causes an electrical circuit including the second power source, the heat detector and the alarm indicator to be completed.

17. An alarm unit according to claim 1, wherein the heat detector comprises a heat switch which can be in an "OFF" state wherein electrical current cannot flow through the heat switch or in an "ON" state wherein electrical current can flow through the heat switch, and wherein at temperatures below a predetermined temperature the heat switch is in the "OFF" state and when temperatures rise above a predetermined temperature the heat switch switches to an "ON" state.

18. An alarm unit according to claim 13 wherein the heat switch comprises a thermistor.

19. An alarm unit according to claim 1, which additionally comprises a control including a receiver and a remote transmitter wherein the smoke detector, the first alarm indicator and the receiver are in electrical communication.

20. An alarm unit according to claim 15 wherein, when the smoke detector detects smoke it is capable of causing a signal which is received by the first alarm indicator which indicates an alarm, and wherein the control is capable of causing cessation of an alarm indicted by the first alarm indicator.

21. An alarm unit according to claim 19, wherein the remote transmitter can be instructed to transmit a signal which can be received by the receiver and when the receiver receives this signal it causes cessation of an alarm indicated by the first alarm indicator, for example by cutting power from the first power source to the smoke detector and the first alarm indicator.

22. An alarm unit according to claim 19 wherein the receiver comprises an infrared receiver and the remote transmitter comprises an infrared transmitter.

23. An alarm unit according to claim 22 wherein the infrared transmitter can be instructed to transmit an infrared signal which can be received by the infrared receiver if the infrared receiver and the infrared transmitter are in a line of sight and are spaced apart no further than a maximum distance in the range of 5 to 10 meters.

24. An alarm unit according to claim 23 wherein the maximum distance at which the infrared transmitter and the infrared receiver can be spaced apart is variable.

25. An alarm unit according to claim 24 wherein the sensitivity of the infrared receiver can be adjusted to alter the maximum distance at which the infrared transmitter and the infrared receiver can be spaced apart.

26. An alarm unit according to claim 22 wherein the infrared receiver and the remote infrared transmitter are provided with means for preventing other infrared devices causing interference with their operation.

27. An alarm unit according to claim 26 wherein the infrared transmitter is capable of transmitting a signal at a specific infrared frequency or tone and the infrared receiver is capable of selectively receiving an infrared signal of the specific frequency or tone.

28. An alarm unit according to claim 26 wherein the infrared transmitter is capable of sending a coded signal and the infrared receiver is capable of selectively receiving a signal with the appropriate code.

29. An alarm unit according to claim 28 wherein the code is a three-digit code.

30. An alarm unit according to claim 19 which additionally comprises a timer.

31. An alarm unit according to claim 30 wherein the timer is in electrical communication with the receiver, the smoke detector and the first alarm indicator, and wherein the timer is activated when the receiver receives a signal from the remote transmitter, and wherein on completion of a predetermined timed period the timer instructs cessation of indication of an alarm by the alarm indicator to cease, for example by restoring power from the first power source to the smoke detector and the first alarm indicator.

32. An alarm unit according to claim 30 wherein the receiver and the timer are capable of receiving electrical power from a third electrical power source.

33. An alarm unit according to claim 32 which comprises terminals for receiving power from the third power source, wherein the receiver and the timer are in electrical communication with the terminals for the third power source.

34. An alarm unit according to claim 19 wherein the remote transmitter is capable of receiving electrical power from an electrical power source.

35. An alarm according to claim 34 wherein the remote transmitter comprises terminals for receiving power from the power source.

36. An alarm unit according to claim 1 which comprises a test facility to enable testing of at least one of the first and second power source to establish whether it has a sufficient level of charge to cause indication of an alarm by the alarm indicator.

37. An alarm unit according to claim 36 wherein the test facility is for testing the second power source and the test facility comprises a switch which is in electrical communication with the second power source and the alarm indicator wherein the switch and the heat detector are connected in parallel.

38. An alarm unit according to claim 19 which comprises a test facility to enable testing of the second power source to establish whether it has a sufficient level of charge to cause indication of an alarm by the alarm indicator, wherein the test facility comprises a switch which is located on the remote transmitter and a receiver which is in electrical communication with the second power source and the alarm indicator, wherein switching of the switch causes completion of an electrical circuit and transmission of a signal from the remote transmitter, and wherein the receiver is capable of receiving the signal, such that when the receiver receives the signal it causes an electrical circuit linking the second power source and the alarm indicator to be completed, allowing an electrical current to pass through the alarm indicator, which thereby indicates an alarm if the second power source has a sufficient level of charge.

39. An alarm unit according to claim 1 which has a housing which defines fixing apertures for mounting the housing to a ceiling.

40. An alarm unit which comprises:

a smoke detector, a heat detector and a first alarm indicator, wherein the smoke detector is configured to receive electrical power from a first electrical power source and the heat detector is configured to receive electrical power from a second electrical power source;

the first alarm indicator being in electrical communication with the first electrical power source and configured to indicate an alarm on receipt of a signal from the smoke detector or the heat detector, and a second alarm indicator in electrical communication with the heat detector, and avoiding electrical communication with the smoke detector, the second alarm indicator being in electrical communication with the second electrical power source and being configured to indicate an alarm on receipt of electrical power from the second electrical power source.

* * * * *